United States Patent [19]

Maestri

[11] Patent Number: 4,875,887

[45] Date of Patent: Oct. 24, 1989

[54] MOBILE TOY

[76] Inventor: Giuseppe Maestri, 19 Leighton Ave., Clinton, Mass. 01510

[21] Appl. No.: 221,675

[22] Filed: Jul. 20, 1988

[51] Int. Cl.[4] ..... A63H 11/00

[52] U.S. Cl. ..... 446/314; 446/316

[58] Field of Search ..... 446/3, 228, 314, 315, 446/316, 317, 322, 377

[56] References Cited

U.S. PATENT DOCUMENTS

| | | | |
|---|---|---|---|
| 839,138 | 12/1906 | Hahn | 446/314 |
| 1,430,371 | 9/1922 | Harvey | 446/377 |
| 1,731,342 | 10/1929 | Mangan | 446/314 |
| 3,393,470 | 7/1968 | Salvador | 446/315 |

FOREIGN PATENT DOCUMENTS

| | | | |
|---|---|---|---|
| 373046 | 3/1922 | Fed. Rep. of Germany | 446/314 |
| 468002 | 11/1928 | Fed. Rep. of Germany | 446/314 |
| 566953 | 2/1924 | France | 446/322 |

*Primary Examiner*—Richard J. Johnson
*Assistant Examiner*—Sam Rimell
*Attorney, Agent, or Firm*—Blodgett & Blodgett

[57] ABSTRACT

An animated toy which consist of a fixed supporting structure and a figure which moves relative to the fixed structure. The fixed structure includes an inclined ramp which has a downwardly extending zig-zag slot. The figure includes a body, a pair of spaced legs which are attached to the body, a tail which is fixed to the body and which extends downwardly and rearwardly from the body into the zig-zag slot, an appendage which is fixed to the body and which extends down to the zig-zag slot, and elongated connector which extends through the slot, and a counterweight which is attached to the lower end of the connector. When the counterweight and the connectors swing from side to side, the firgure also swings from side to side in a direction which is opposite to that of the counterweight. As the figure moves from side to side, the tail moves along the zig-zag slot. This causes the body to turn slightly about a vertical axis as it rocks from side to side and enables the body to advance progressively down the ramp.

5 Claims, 3 Drawing Sheets

MOBILE TOY

BACKGROUND OF THE INVENTION

A number of gravity driven mobile toys have been developed for producing diverse motion effects. In many cases, a figure moves relative to a fixed structure under the influence of gravity. Different types of motion are produced as the figure advances along an inclined path. The figure may turn, rock, or oscillate as it descends. However, none of the prior art toys cause a figure to simulate a walking motion, in general, or a bipedal walking motion, in particular, as the figure advances downwardly along an inclined path.

It is, therefore, a principle object of the invention to provide a mobile toy in which a figure is driven solely by gravity and simulates a walking motion.

Another object of this invention is the provision of a mobile toy having a gravity driven figure which simulates a bipedal walking motion.

A further object of the present invention is the provision of a mobile toy which is simple to play with and is attractive to children of all ages, because of the unique and interesting motion of the figure.

With these and other objects in view, as will be apparent to those skilled in the art, the invention resided in the combination of parts set forth in the specification and covered by the claims appended hereto.

SUMMARY OF THE INVENTION

In general, the invention consist of a mobile toy comprising an inclined ramp having a zig-zag slot and a figure which advances downwardly along the slot. The figure has a body, a pair of spaced legs which are located on opposite sides of the slot, a tail which extends into the slot, an appendage which extends downwardly from the body to the slot, an elongated connector which is attached to the appendage and which extends through the slot, and a counterweight which is attached to the connector. The counterweight and connector function as a pendulum within a vertical plane which is transverse to a slot. This motion causes the body to rock from side to side on the ramp so that the tail moves from one side of the zig-zag slot to the opposite side of the zig-zag slot, thereby, imparting a turning motion to the body as it rocks and causing the body to advance progressively down the ramp.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 3:
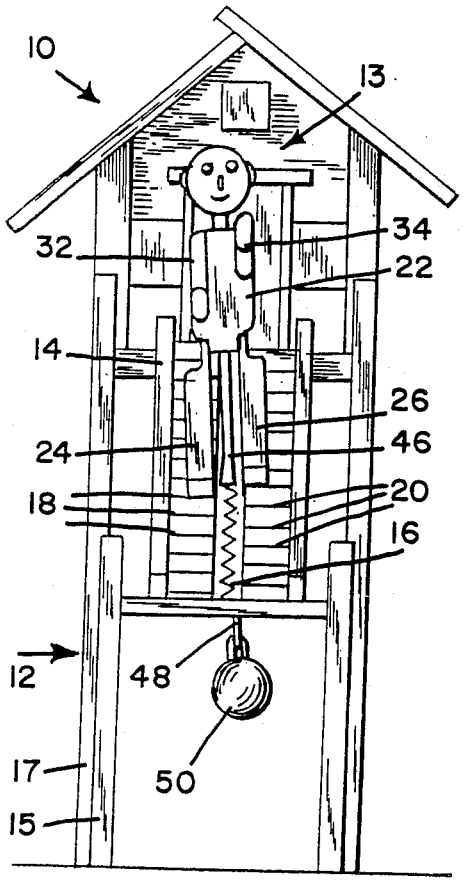
FIG. 3 is a front elevational view of the toy, showing the figure in a leaning position toward one side of the toy.
Figure 4:
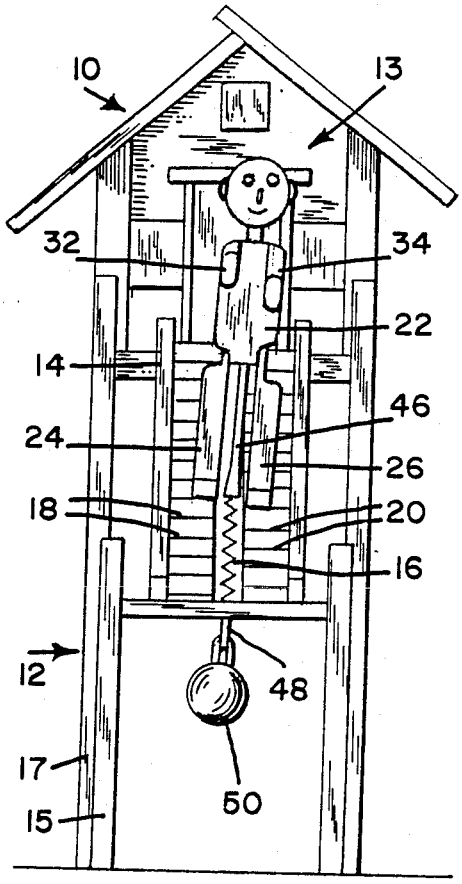
FIG. 4 is a figure similar to FIG. 3, showing the figure which forms part of the toy leaning towards the opposite side of the fixed portion of the toy.

Referring to the drawings, the mobile toy of the present invention is generally indicated by the reference numeral 10 and comprises, a fixed structure which is generally indicated by the reference numeral 12 and a toy figure which is generally indicated by the reference numeral 13. The fixed structure 12 comprises a pair of supporting bases 15 and 17, and an inclined ramp 14 which extends downwardly from the base 17 to the base 15. The inclined ramp 16 has a zig-zag slot 16 which extends at a downward angle along the length of the ramp. A plurality of steps 18 are located on one side of the slot 16 and a plurality of steps 20 are located on the opposite side of the slot 16. The steps 18 are offset from the steps 20 by an amount which is ½ of the distance between two steps in either of the group of steps 18 or 20, as shown more clearly in FIGS. 3 or 4.

Figure 1:
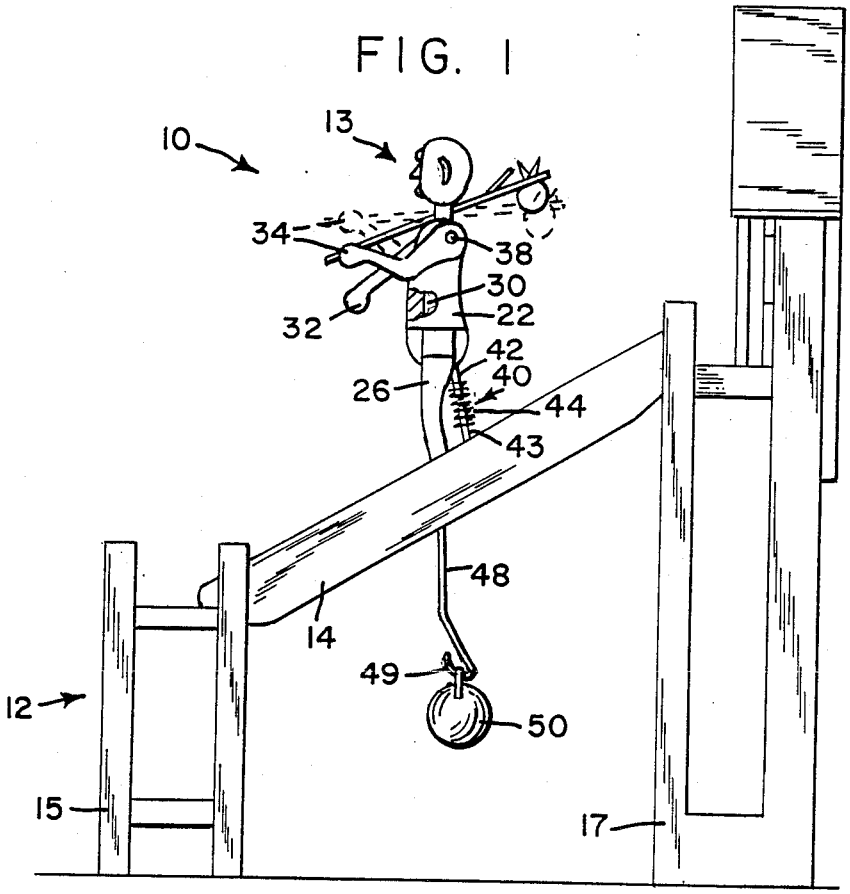
FIG. 1 is a side elevational view of a mobile toy embodying the principles of the present invention.
Figure 5:
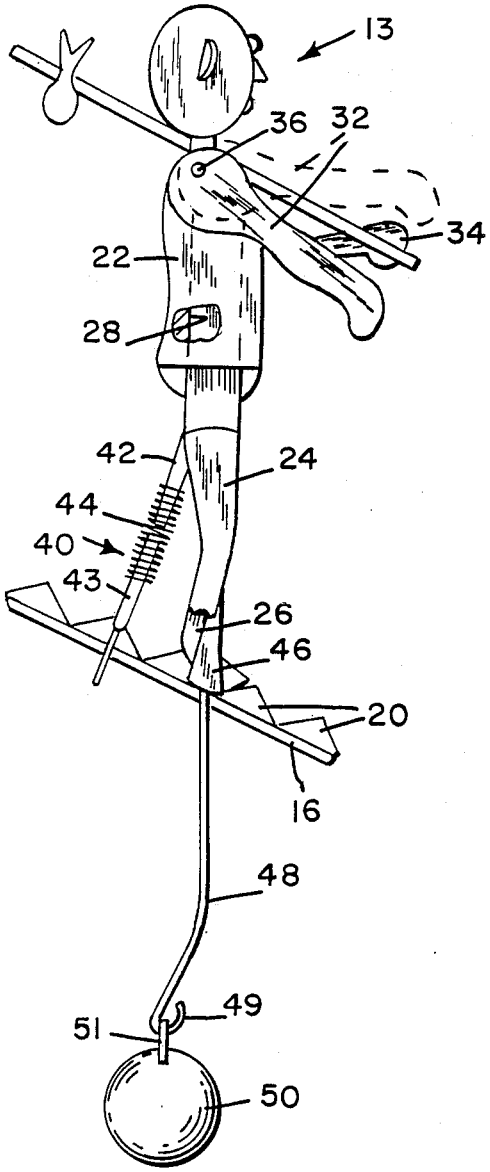
FIG. 5 is an enlarge side elevational view of the toy figure and its relationship with the ramp which forms the fixed portion of the toy.

The FIG. 13 comprises a body portion 22, a pair of legs 24 and 26, and a pair of arms 32 and 34. The right leg 24 is slidably mounted within a slot 28 in the body 22 for vertical movement relative to the body, see FIG. 5. The left leg 26 is slidably mounted within a slot 30 in the body 22 for vertical movement relative to the body 22, see FIG. 1. The right arm 32 is pivotally mounted to the body 22 by means of a pivot pin 36, as shown in FIG. 5. The left arm 34 is pivotally mounted to the body 22 by means of a pivot pin 38, as shown in FIG. 1. The right arm 32 normally rests on the top edge of the leg 24 so that upward movement of the leg 24, causes the right arm 32 to move from the full line position shown in FIG. 5, to the dotted line position. The left arm 34 rests on the top edge of the leg portion 26 so that upward movement of the leg 26 within the slot 30, causes the left arm 34 to move from the full line position to the dotted line position shown in FIG. 1. A tail portion, generally indicated by the reference numeral 40, is attached to the lower end of the body portion 22 and extends downwardly and rearwardly from the body portion. The tail portion comprises an upper part 42 which is fixed to the body 22 and a lower part 43 which extends into the slot 16 and is connected to the upper part 42 by means of a spring 44. An appendage 46 is also connected to the lower end of the body portion 22 and extends downwardly between the right and left legs 24 and 26, respectively, to the ramp 14 above the slot 16. The upper end of an elongated connector 48 is attached to the lower end of the appendage 46, so that the connector 48 extends below the slot 16 as shown best in FIG. 5. The lower end of the connector 48 has a hook 49 which hooks into a loop 51 of a counterweight 50 for supporting the counterweight.

Figure 2:
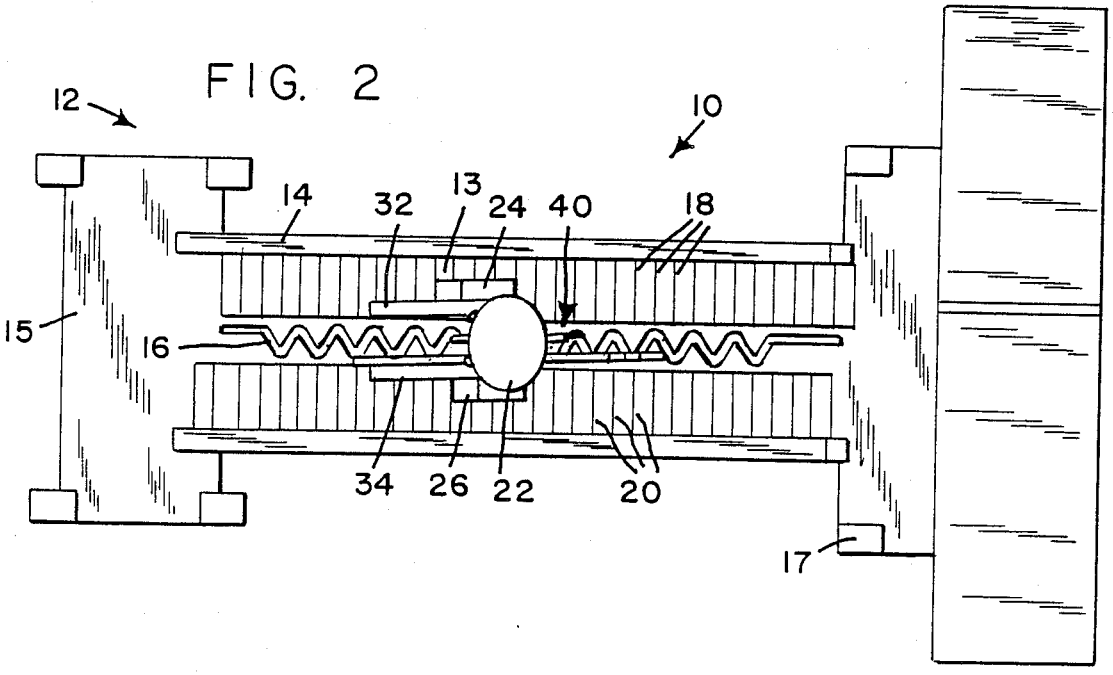
FIG. 2 is a plan view of the toy.

The operation and advantages of the present invention will now be readily understood in view of the above description. At the beginning of a sequence the toy FIG. 13 is place at the top of the ramp 14 so that the right leg 24 is positioned on one of the steps 18, and the left leg 26 is positioned on one of the steps 20. The lower part 43 of the tail 40 extends into the slot 16 and the appendage 46 rest on top of the ramp above the slot 16. Animation of the FIG. 13 is initiated by imparting a swinging motion to the counterweight 50 within a vertical plane which is transverse to the longitudinal axis of the ramp 14. This causes FIG. 13 to rock from left to right as viewed in FIGS. 3 and 4, opposite to the swinging direction of the counterweight 50 as the counterweight 50 swings to the right as viewed in FIG. 3, the FIG. 13 swings to the left or to the figures right. As the counterweight 50 swings to the left as viewed in FIG. 4, the FIG. 13 swings to the right or to the figures left. Referring also to FIG. 2, when the FIG. 13 swings to its right the tail 40 moves along a portion of the zig-zag slot 16 which extends downwardly to the right of the figure. This causes the FIG. 13 to rotate slightly about the central longitudinal vertical axis of the figure. This also enables the right leg 24 of the figure to advance downwardly by the amount of one step 18. As the right leg 24 advances one step along the steps 18, the left leg 26 moves upwardly relative to the FIG. 13, thereby the left arm 34 to move from the full line position to the dotted line position as shown in FIG. 1. When the FIG. 13 swings to its left as viewed in FIG. 4, the tail 40 moves along a section of the zig-zag slot 16 which extends downwardly into the left of the FIG. 13. This imparts to the FIG. 13 a slight clockwise turning motion as viewed in FIG. 2, about the vertical central longitudinal axis of the figure. This turning motion enables the left leg 26 to advance one step down the steps 20. As the left leg 26 moves down one step, the right leg 24 moves upwardly relative to the body 22, thereby causing the right arm to move from the full line position to the dotted line position as shown in FIG. 5. This action continues until the FIG. 13 reaches the bottom of the steps 18 and 20. Therefore, as the FIG. 13 rocks from side to side, the figure also rocks slightly about its vertical axis in alternating clockwise and counter clockwise directions. This causes the figure to advance down the steps 18 and 20 one step at a time alternating between groups of step 18 and 20. During each downward increment of advance of the figure, the advancing leg moves downwardly relative to the body 22 of the figure and the opposite leg moves upwardly relative to the body of the figure. The movement of the FIG. 13 simulates a bipedal walking motion with simultaneous vertical swinging of the arms 32 and 34.

It is obvious that minor changes may be made in the form and construction of the invention without departing from the material spirit thereof It is not, however, desired to confine the invention to the exact form herein shown and described, but it is desired to include all such as properly come within the scope claimed.

The invention having been thus described, what is claimed as new and desired to secure by Letters Patent is:

1. A toy comprising:

(a) a supporting base which is adapted to rest on a horizontal surface, (b) an inclined ramp which is mounted on said supporting base, said ramp having a continuous zig-zag slot which extends along an axis which is at an angle to the horizontal when said supporting base rests on a horizontal surface, said slot constituting first and second alternating short portions, each of said first portions extending downwardly at an angle to said axis toward one side of said axis and each of said second short portions extending downwardly at an angle to said axis toward the opposite side of said axis, and (c) a figure which comprises:

(1) a body having a longitudinal axis which is normally vertical, (2) a pair of spaced legs which are mounted to said body and which extend downwardly from said body to said ramp on opposite sides of said slot, (3) a tail which is fixed to said body and which extends downwardly and rearwardly from the body into said slot, (4) an appendage which is fixed to said body and which extends downwardly from the body between said legs to said slot, said appendage having a lower free end, (5) an elongated connector which extends through said slot, said connector having an upper end which is connected to the lower end of said appendage, and a lower end which extends below said slot, and (6) a counterweight which is attached to the lower end of said connector so that said counterweight and said connector form a pendulum having a focal point at the lower free end of said appendage, wherein the swinging of said pendulum in a vertical plane which is transverse to a horizontal axis which is vertically aligned with the axis of said slot causes said body to oscillate from side to side within said plane while said tail moves progressively from one short portion said slot to the next lower short portion said slot, thereby causing said body to partially rotate about its longitudinal axis in one direction and then in the opposite direction for each oscillation of said body, thereby advancing each of said legs alternately forwardly down said ramp to enable said figure to advance progressively down said ramp.

2. A toy as recited in claim 1, wherein the lower free end of said appendage engages said ramp and wherein each of said legs is slidably mounted on said body for vertical movement relative to the body, so that when the body swings toward either one of said legs, said one leg moves downwardly along said ramp relative to the body.

3. A toy as recited in claim 2, wherein a plurality of steps are located on each side of said slot, the steps on one side of the slot being staggered to the extent that the lowest point of each step on one of said slot is one-half the distance along said axis between the lowest points of two adjacent steps on the opposite side of said slot and when the figure swings to the opposite side of the slot, the leg which is adjacent said opposite side advances one step down the steps on said opposite side.

4. A toy as recited in claim 2, wherein said body has a vertical groove on each side of said body and said legs are respectively slidably mounted within said grooves.

5. A toy as recited in claim 4, wherein said figure has at least one arm which is pivotally connected to said body for movement about a horizontal axis and one of said legs is operatively connected to said arm so the vertical movement of said one leg causes said arm to pivot about said horizontal axis.

* * * * *